US010892583B2

(12) United States Patent
Chan

(10) Patent No.: US 10,892,583 B2
(45) Date of Patent: Jan. 12, 2021

(54) EXPANDABLE AND UPGRADEABLE UNIVERSAL SOCKET

(71) Applicant: Kwok Leung Chan, Hong Kong (CN)

(72) Inventor: Kwok Leung Chan, Hong Kong (CN)

( * ) Notice: Subject to any disclaimer, the term of this patent is extended or adjusted under 35 U.S.C. 154(b) by 0 days.

(21) Appl. No.: 16/566,863

(22) Filed: Sep. 10, 2019

(65) Prior Publication Data

US 2020/0006886 A1 Jan. 2, 2020

Related U.S. Application Data

(63) Continuation of application No. PCT/CN2018/102250, filed on Aug. 24, 2018.

(30) Foreign Application Priority Data

Aug. 1, 2017 (CN) ..... 2017 1 0644509
Aug. 1, 2017 (CN) ..... 2017 2 0945543

(51) Int. Cl.
*H01R 13/514* (2006.01)
*H01R 13/518* (2006.01)
(Continued)

(52) U.S. Cl.
CPC ..... *H01R 13/514* (2013.01); *H01R 13/518* (2013.01); *H01R 13/6675* (2013.01); *H01R 27/00* (2013.01)

(58) Field of Classification Search
CPC . H01R 12/514; H01R 12/518; H01R 12/6675
(Continued)

(56) References Cited

U.S. PATENT DOCUMENTS 6,220,880 B1 * 4/2001 Lee ..... H01R 25/003 439/214
6,830,477 B2 * 12/2004 Vander Vorste ..... H01R 13/743 439/214

(Continued)

FOREIGN PATENT DOCUMENTS

CN 103117476 A * 5/2013
CN 205790624 U 12/2016

(Continued)

OTHER PUBLICATIONS

CN103117476A_translation, 2013.*

*Primary Examiner* — Abdullah A Riyami
*Assistant Examiner* — Marcus E Harcum
(74) *Attorney, Agent, or Firm* — Wayne & Ken, LLC; Tony Hom

(57) ABSTRACT

An expandable and upgradeable universal socket, including a socket body and a function module. The function module is replaceable and upgradeable, and is detachably fixed to the socket body. A power circuit of the function module is separably connected to a power circuit of the socket body to enable the function modules to plug and play. A space is provided in the socket body to accommodate the functional module, and a surface of the socket body is provided with a function area corresponding to the function module. Various expanded function modules can be matched and arranged in the reserved space. Small electronic components can be accommodated in the socket bottom box, and the number of external power transformers are reduced, which saves space, reduces exposed wires and beautifies the appearance. There is no need to replace the entire socket when upgrading the socket, which is environmentally friendly and energy saving.

12 Claims, 13 Drawing Sheets

(51) Int. Cl.
*H01R 13/66* (2006.01)
*H01R 27/00* (2006.01)

(58) Field of Classification Search
USPC ..... 439/170, 171
See application file for complete search history.

(56) References Cited

U.S. PATENT DOCUMENTS 7,556,511 B1 * 7/2009 Hsu ..... H01R 13/652 439/119
8,033,867 B1 * 10/2011 Kessler ..... H01R 25/003 439/652
8,579,656 B2 * 11/2013 Huang ..... H01R 35/04 439/171
8,610,402 B2 * 12/2013 Giribet Guadamillas ..... H01R 13/6315 320/114
8,625,255 B2 * 1/2014 Linnane ..... H02G 3/0608 361/611
9,201,482 B2 12/2015 Lin
9,608,418 B1 * 3/2017 Elberbaum ..... H02G 3/14
9,812,830 B1 * 11/2017 Chuang ..... H01R 13/514
10,050,393 B1 * 8/2018 Calabrese ..... H01R 25/006
10,084,272 B1 * 9/2018 Hayes ..... H01R 27/02
10,317,972 B2 * 6/2019 Jen ..... H02J 13/0006
10,524,377 B2 * 12/2019 Smith ..... H01R 13/7175
2004/0259413 A1 * 12/2004 Chou ..... H01R 13/514 439/541.5
2005/0186857 A1 * 8/2005 Sichner ..... H05K 7/1478 439/717
2008/0188106 A1 * 8/2008 Byrne ..... H02G 3/288 439/215
2008/0305693 A1 * 12/2008 Mei ..... H01R 31/06 439/701
2010/0075544 A1 * 3/2010 Liu ..... H01R 13/6595 439/701
2011/0003505 A1 * 1/2011 Greig ..... B64D 11/0624 439/540.1
2011/0171842 A1 * 7/2011 Senatori ..... H01R 29/00 439/171
2011/0205693 A1 * 8/2011 Jansma ..... H01R 25/003 361/601
2012/0161973 A1 * 6/2012 Hsu ..... H01R 13/70 340/584
2013/0149900 A1 * 6/2013 Zhang ..... H01R 13/659 439/607.01
2013/0280956 A1 * 10/2013 Cheng ..... H02G 3/14 439/620.15
2015/0280410 A1 * 10/2015 Elberbaum ..... H02G 3/18 361/679.01
2016/0072216 A1 * 3/2016 Pastars ..... H01R 13/518 439/367
2017/0018896 A1 * 1/2017 Mortun ..... H01R 13/518
2017/0063000 A1 * 3/2017 Seger ..... H01R 13/73
2018/0062302 A1 * 3/2018 DeBlois ..... H01R 9/2408
2018/0109054 A1 * 4/2018 Chin ..... H01R 25/003
2018/0337498 A1 * 11/2018 Lin ..... H01R 13/514
2019/0067883 A1 * 2/2019 Yilmaz ..... H02J 3/14
2019/0239379 A1 * 8/2019 Smith ..... H05K 7/1457
2019/0280782 A1 * 9/2019 Elberbaum ..... H04B 10/07955

FOREIGN PATENT DOCUMENTS

CN 206135157 U 4/2017
CN 107453110 A 12/2017
CN 207490183 U 6/2018
WO WO-2013098649 A2 * 7/2013 ..... H01R 24/60

* cited by examiner

EXPANDABLE AND UPGRADEABLE UNIVERSAL SOCKET

CROSS-REFERENCE TO RELATED APPLICATIONS

This application is a continuation of International Application No. PCT/CN2018/102250 with a filing date of Aug. 24, 2018, designating the United States, now pending, and further claims to Chinese Application No. 201710644509.3 with a filing date of Aug. 1, 2017 and Chinese Application No. 201720945543.X with a filing date of Aug. 1, 2017. The content of the aforementioned applications, including any intervening amendments thereto, are incorporated herein by reference.

TECHNICAL FIELD

The present invention relates to electrical connection devices and electrical equipments, and more particularly to an expandable and upgradeable socket as an improvement of conventional wall-mounted power sockets or buried power sockets or extension boards. The expandable and upgradeable socket can be expanded into various types of sockets with mains power connection which are mounted with or without wires showing.

BACKGROUND OF THE PRESENT INVENTION

In the prior art, as shown in FIGS. 1-3, the conventional single unit or double-unit socket generally comprises a socket panel 2 provided with typical power outlets for connection with AC mains. The conventional three-pin power socket 12 comprises a live hole, a neutral hole and a ground hole, and the two-pin power socket 13 comprises a live hole and a neutral hole. Sockets used in various countries adopt the same principle and differ only in shapes and voltages.

With the development of electronic technology, there are a large number of small-sized electrical devices such as mobile phones, tablets, cameras, etc. Most of these electronic products are powered through USB interfaces, and wireless internet can be accessed via WiFi or Bluetooth.

However, when using the existing socket, an external USB power supply (charger) needs to be connected to the power socket, which is inconvenient to use, and the external USB power supply protrudes from the surface of the socket and takes up a large space. Moreover, the technology of the USB power supply advances rapidly, so both the standards of the output power and outlets are continuously upgraded and changed with the iteratively updated technology. The commonly used WiFi routers or repeaters are generally external, that is, they need to be powered by plugging into a power socket and take up space.

At the same time, both the socket with AC mains supply and the socket with a power switch function are single and simple in function and structure, and there is no reserved space and connection interface for extended functions in the future. In addition, there is no structure for taking out the function module on the front side of the socket. Therefore, it is necessary to address the above deficiencies.

SUMMARY OF THE PRESENT INVENTION

The existing sockets cannot be expanded, upgraded or replaced due to their poor adaptability and simple features.

Electronic products connected to the conventional power socket evolve rapidly, so specifications and standards of the socket need to be upgraded or replaced after one or two years. To overcome the shortcomings in prior art, the invention provides a universal socket that is environmentally friendly, economical, safe, expandable and upgradeable. In this socket, there is no need to replace the entire wall socket, buried socket or socket strip; instead, the function module only needs to be replaced without pulling out the entire socket.

An expandable and upgradeable universal socket comprises a socket body and a function module. The function module is replaceable and upgradeable, and is detachably fixed to the socket body. A power circuit of the function module is separably connected to a power circuit of the socket body to enable the function module to plug and play. A space is provided in the socket body to accommodate the function module, and a surface of the socket body is provided with a function area corresponding to the function module.

Further, the expandable and upgradeable universal socket further comprises a bypass plug and a bypass socket which are respectively located at the function module and the socket body. The bypass plug matches with the bypass socket, so that the power circuit of the function module is separably connected to the power circuit of the socket body.

Further, the function module is configured for at least one of a USB interface, a network interface, a Bluetooth management, a wireless management, a power switch, a speaker and a night light.

Further, a panel for the function area on the surface of the socket body is detachably fixed to the socket body, and the panel is replaced and upgraded correspondingly with the function module. Further, the function module is directly and detachably fixed to the socket body; or the function module is detachably fixed to an auxiliary member which is then fixed to the socket body.

Further, a plurality of hooks or holes are arranged at a periphery or a bottom of the panel for a detachable and fixed connection between the panel and the socket body; or the panel are detachably fixed to the auxiliary member which is then fixed to the socket body.

Further, the auxiliary member is a fixing frame.

Further, the bypass plug is a bypass pin. The bypass socket is a bypass pin socket provided with a plurality of small holes.

Further, the power circuit comprises a live circuit, a neutral circuit and a ground circuit.

Further, the socket body is a mobile socket or a fixed socket.

The invention provides the following beneficial effects. A space is provided in the socket body for users to match different expanded function modules, thereby greatly improving the functions of wall sockets or extension boards. Many small electronic components can be accommodated in the socket bottom box, and the number of external power transformers are reduced, which saves space, reduces exposed wires and increases aesthetic beauty. There is no need to replace the entire wall socket, buried socket or socket strip when upgrading, which is environmentally friendly and energy saving. The function module can be expanded without the help of electricians, which is convenient and efficient. Moreover, when used together with a power supply via USB interface, the socket of the present invention not only keeps the functions of ordinary power sockets, but also provides power for small electronic equipments, thus eliminating the need for users to carry external chargers. This fits in the development of modern-day technology and science, and benefits users.

BRIEF DESCRIPTION OF THE DRAWINGS

The present invention will be described in detail with reference to the accompanying drawings and embodiments.

Figure 1:
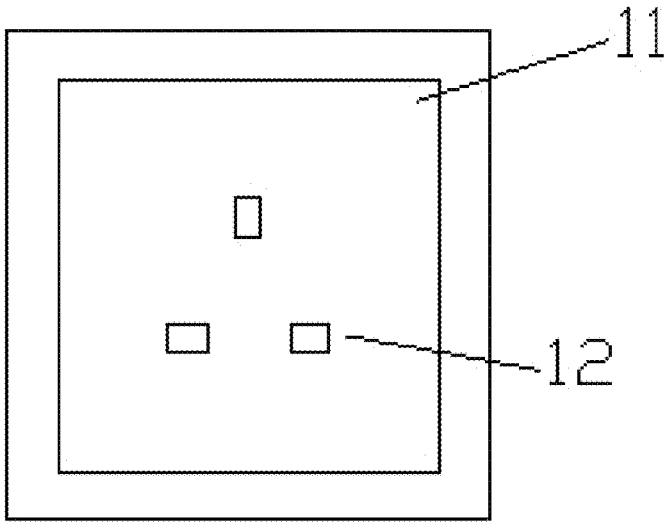
FIG. 1 (Prior Art)
FIG. 1 is a front view of a British standard single unit wall power socket of prior art.

In the drawings: 11—socket panel, 12—three-pin power socket, 13—two-pin power socket, 14—power switch, 15—earth contact, 151—ground metal sheet, 16—live contact, 161—live connection port, 17—neutral contact, 171—neutral connection port, 2—socket panel, 3—function module, 30—function module top cover, 31—function module bottom box, 32—USB socket, 33—night light, 34—power switch, 35—WiFi management, 36—power network setup, 37—WAN/LAN interface, 38—Bluetooth management, 39—speaker, 301—screw hole, 302—hook, 311—hole, 312—bypass pin; 4—power module, 41—power module top cover, 42—power module bottom box, 420—bypass pin socket, 421—bypass live outlet, 422—bypass ground outlet, 423—bypass neutral outlet, 424—screw hole; 5—socket bottom box; 6—fixing frame; 7—extension cord.

DETAILED DESCRIPTION OF THE PRESENT INVENTION

The invention will be further described below in conjunction with the accompanying drawings and embodiments.

Figure 2:
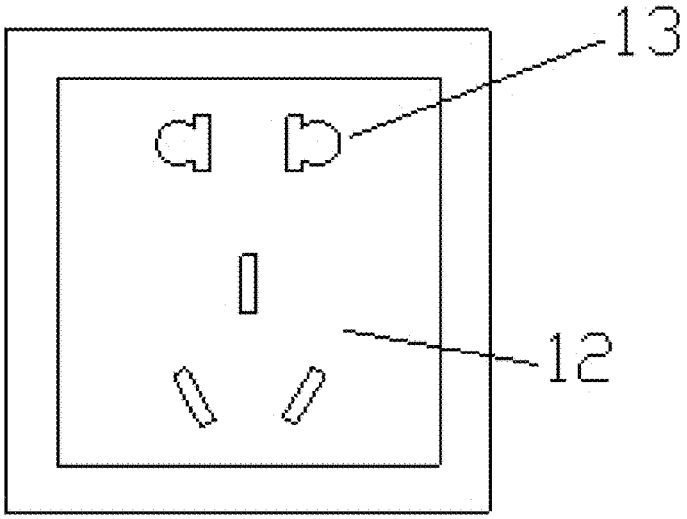
FIG. 2 (Prior Art)
FIG. 2 is a front view of Chinese standard single unit wall power socket of prior art.
Figure 3:
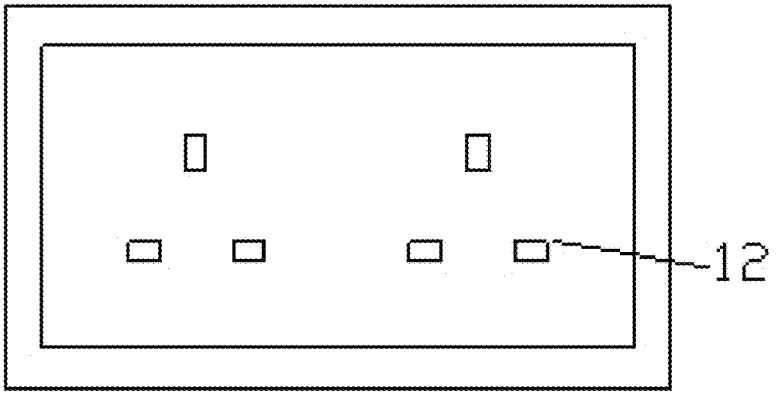
FIG. 3 (Prior Art)
FIG. 3 is a front view of British standard double-unit wall power socket of prior art.

As shown in FIGS. 1-3, existing socket bodies in different forms are illustrated. The power outlets on the socket panel 11 may be a conventional AC three-pin power socket 12 or a two-pin power socket 13, which is not limited to the number, shape, standard and voltage of the outlets.

Example 1

Figure 4:
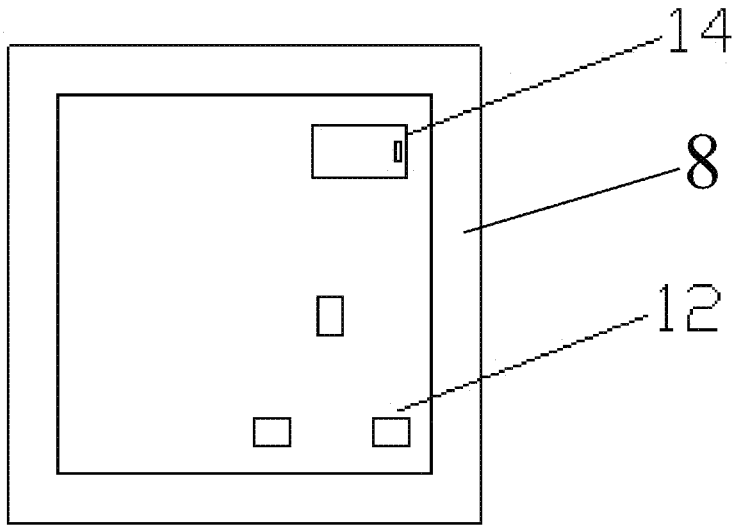
FIG. 4 is a front view of a single unit wall power socket according to a first embodiment of the invention.
Figure 5:
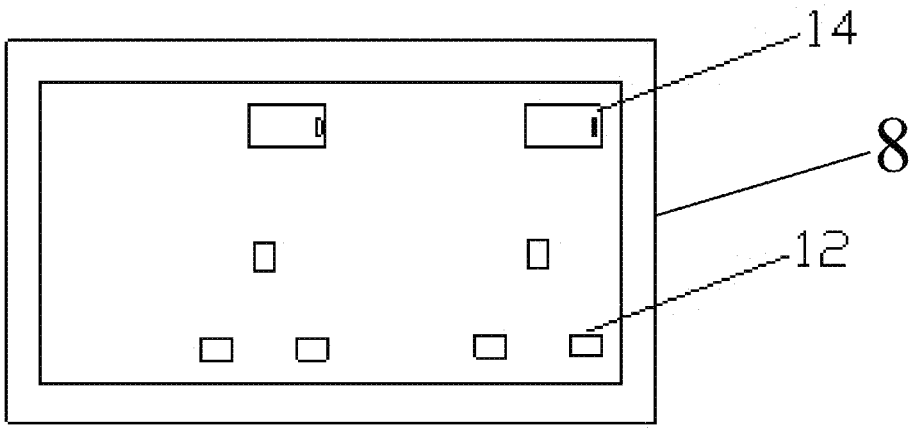
FIG. 5 is a front view of the double-unit wall power socket according to the first embodiment of the invention.
Figure 6:
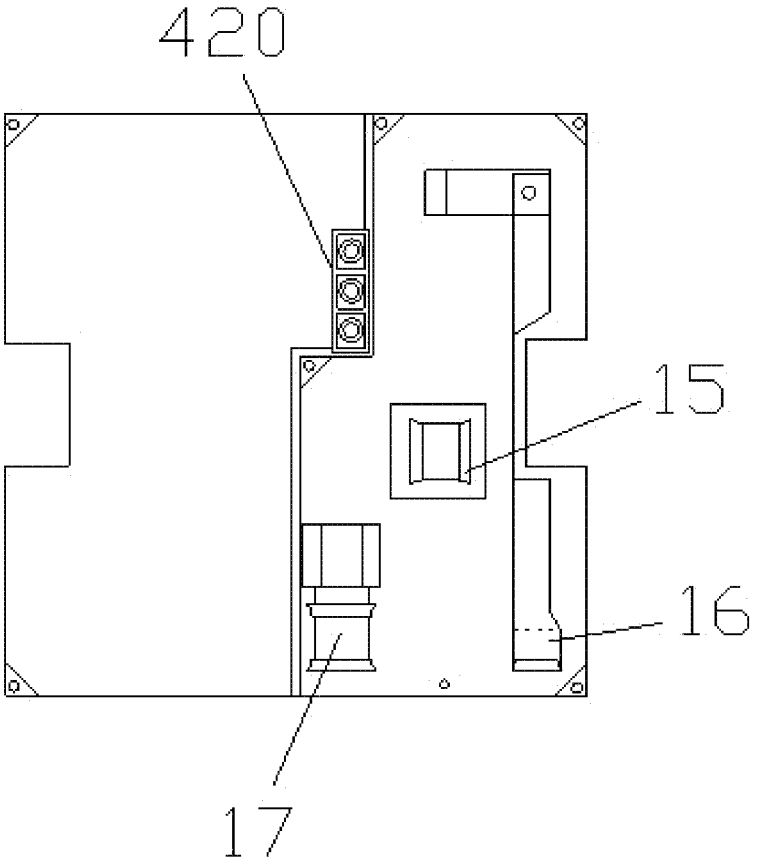
FIG. 6 is a front view showing a part of an interior of a socket according to the first embodiment of the invention.
Figure 7:
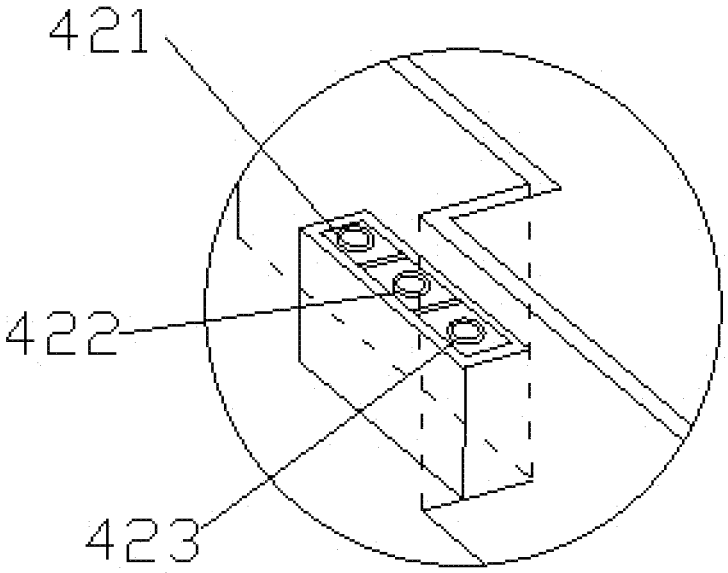
FIG. 7 is an enlarged diagram of a bypass pin socket in FIG. 6.
Figure 8:
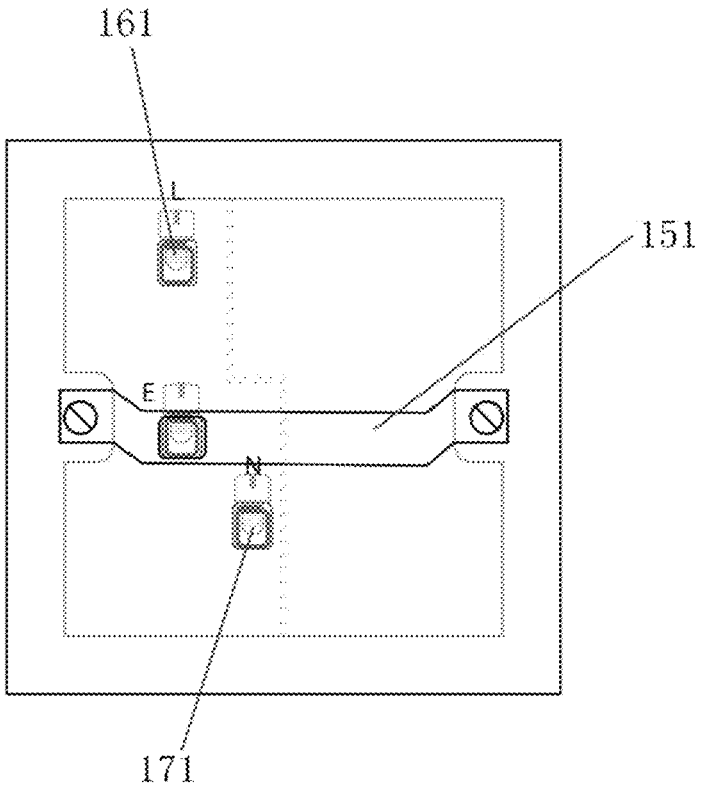
FIG. 8 is a rear view of the socket according to the first embodiment of the invention.
Figure 9:
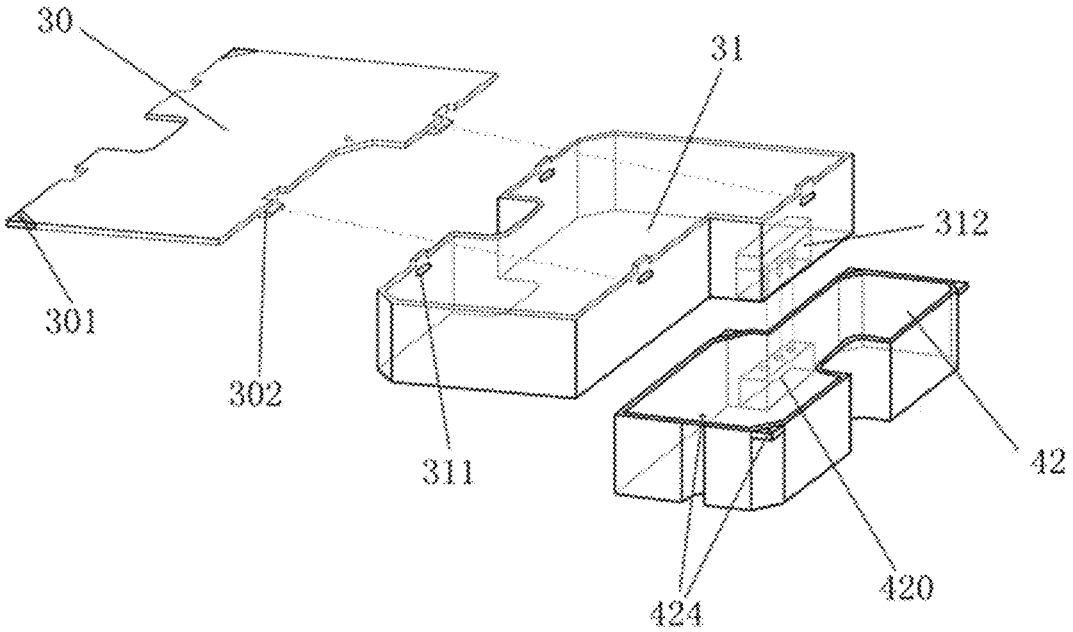
FIG. 9 is a partial schematic view showing the connection of the socket according to the first embodiment of the invention.
Figure 10:
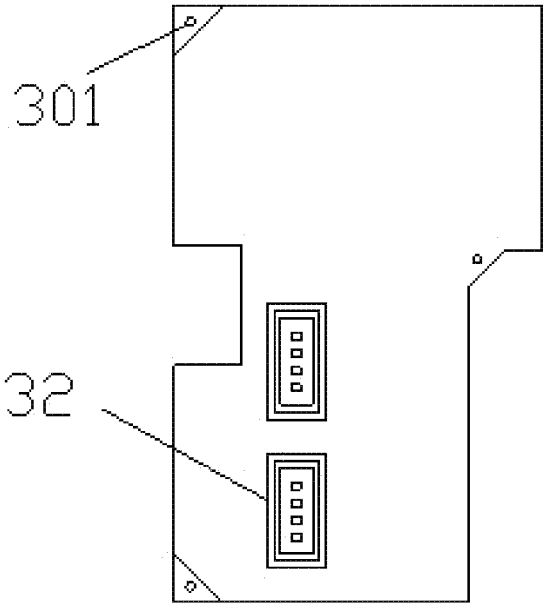
FIG. 10 is a front view showing a first implementation of a function module of the socket according to the first embodiment of the invention.
Figure 11:
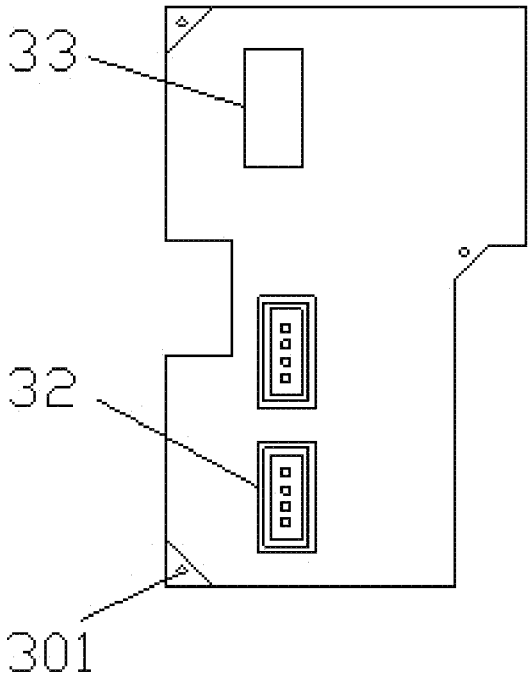
FIG. 11 is a front view showing a second implementation of the function module of the socket according to the first embodiment of the invention.
Figure 12:
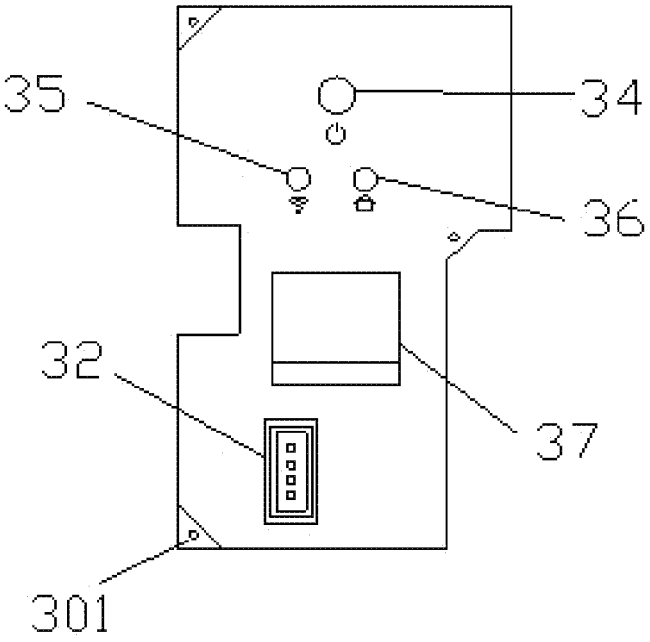
FIG. 12 is a front view showing a third implementation of the function module of the socket according to the first embodiment of the invention.
Figure 13:
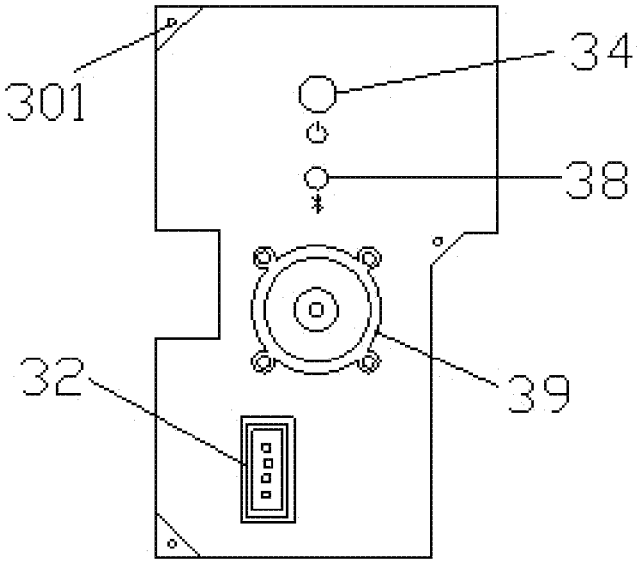
FIG. 13 is a front view showing a fourth implementation mode of the function module according to the first embodiment of the invention.

As shown in FIGS. 4-14, provided is an expandable and upgradeable universal socket, including a socket body 8 and a function module 3. The function module 3 which is replaceable and upgradeable is detachably fixed to the socket body 8, and a power circuit of the function module 3 is separably connected to a power circuit of the socket body 8 to enable the function module to plug and play. A space is provided in the socket body 8 to accommodate the function module 3, and a panel of the socket body 8 is provided with a function area corresponding to the function module 3. As shown in FIGS. 4 and 5, a usage range of the function area is reserved on the socket panel, therefore, when the this example is implemented, the use of the power socket 12 will not be affected, improving a space utilization of the socket panel, and facilitating various function extensions.

In this embodiment, the expandable and upgradeable universal socket is a fixed socket, and includes a socket panel 2, a fixing frame 6, a function module 3, a power module 4 and a socket bottom box 5. The socket bottom box 5 can be fixedly mounted within a wall surface or a ground, and is configured to accommodate the function module 3 and the power module 4. The function module 3 and the power module 4 are arranged in a left-right structure, and the function module 3 comprises a function module top cover 30 and a function module bottom box 31, two USB sockets 32 and a bypass pin 312. The power module 4 of the socket body 8 comprises a power module bottom box 42. A earth contact 15, a live contact 16, and a neutral contact 17 are accommodated in the power module bottom box 42. The power module bottom box 42 further comprises a bypass pin socket 420 matching the bypass pin 312, so that the power circuit of the function module 3 is separably connected to the power circuit of the socket body 8. Bypass holes are very thin, and human fingers cannot contact with electrode units therein, which is very safe.

The bypass pin socket 420 comprises a bypass live outlet 421, a bypass ground outlet 422, and a bypass neutral outlet 423, and the bypass pin 312 includes corresponding pins.

In this embodiment, function components with different functions are accommodated in the function module bottom box. The function module top cover 30 and the function module bottom box 31 are detachably fixed by hooks 302 and holes 311, contributing to the repair, upgrade and reuse of the function module 3.

In this embodiment, the earth contact 15 is connected to a ground metal sheet 151 and a ground wire. The live contact 16 is connected to a live wire of the AC power source through a live connection port 161. The neutral contact 17 is connected to a neutral wire of the AC power source through a neutral connection port 171. A power switch 14 is disposed in a live circuit.

In this embodiment, as shown in FIGS. 10-13, the function module 3 can also be implemented by setting with one or more of a USB socket 32, a night light 33, a power switch 34, a WiFi management 35, a power network setup 36, a WAN/LAN interface 37, a Bluetooth management 38 and a speaker 39 to provide corresponding functions. The USB socket 32 is used for small electronic equipments which are powered via USB. According to requirements, a USB output interface may be a Micro-USB interface, a Type-C interface or other interface type to adapt to the interfaces of different electronic products. One or more USB interfaces may be provided, depending on the use and available space. The function module is independent and may be optionally used as some external products such as a USB power supply, a LED night light, a wireless repeater, a detector, a speaker. With the rapid development of technology, these function modules are constantly being upgraded. Users can easily replace and upgrade the function module without replacing the entire wall power sockets, buried sockets or extension boards, which is environmental and energy saving. Different function modules can be freely combined by users. Each function module will be equipped with a new cover to match both the socket with new function module and the original conventional power socket.

In this embodiment, the power module 4 is fixed to the screw hole 424. The function module 3 is fixed to the fixing frame 6 through the screw hole 301, and can also be detachably fixed to the fixing frame 6 by providing bottom fasteners on the function module 3. The two sides of the fixing frame 6 are fixed to the socket bottom box 5 by screws, and the socket panel 2 can be replaced and upgraded according to corresponding function module 3. The material may be plastic or metal with different colors or patterns. In order to match the holes of different function modules 3, the socket panel 2 can have holes with different positions and number. Screw holes are not visible on the socket panel 2, because the socket body 8 is fixed by fasteners provided at a periphery or a bottom thereof, achieving an aesthetic and clean appearance. When the function module 3 is required to be replaced, only the screws on the socket panel 2 and in the screw hole 301 are removed, and the function module can be removed, and then the screws and the socket panel 2 corresponding to the replaced function module 3 are attached.

In this embodiment, the socket bottom box 5, the power module bottom box 42 and the bypass pin socket 420 may be an integral structure. The bypass pin socket 420 is preferably located at a bottom end of an outer side of the power module bottom box 42 to make a stable and reliable engagement. The bypass pin 312 is preferably located at a bottom end of an inner side of the function module bottom box 31, and the bottom of the function module bottom box 31 is provided with an opening. During use, the bypass pin 312 can be vertically inserted into the bypass pin socket 420, so that the AC mains reserved in the socket body 8 is supplied to the function module 3. The bypass pin 312 cooperates with the bypass pin socket 420, which is space-saving, stable and reliable. In some embodiments, a cooperation of the bypass pin socket and the bypass pin can be replaced by a cooperation of conductive elastic contacts to connect the function module 3 with the power module 4, so that the power supply of the function module is achieved. The bypass pin socket 420 can be connected to the earth contact 15, the live contact 16 and the neutral contact 17 via wires, and can be connected with power wires of the socket body 8 to realize a circuit connection.

Figure 14:
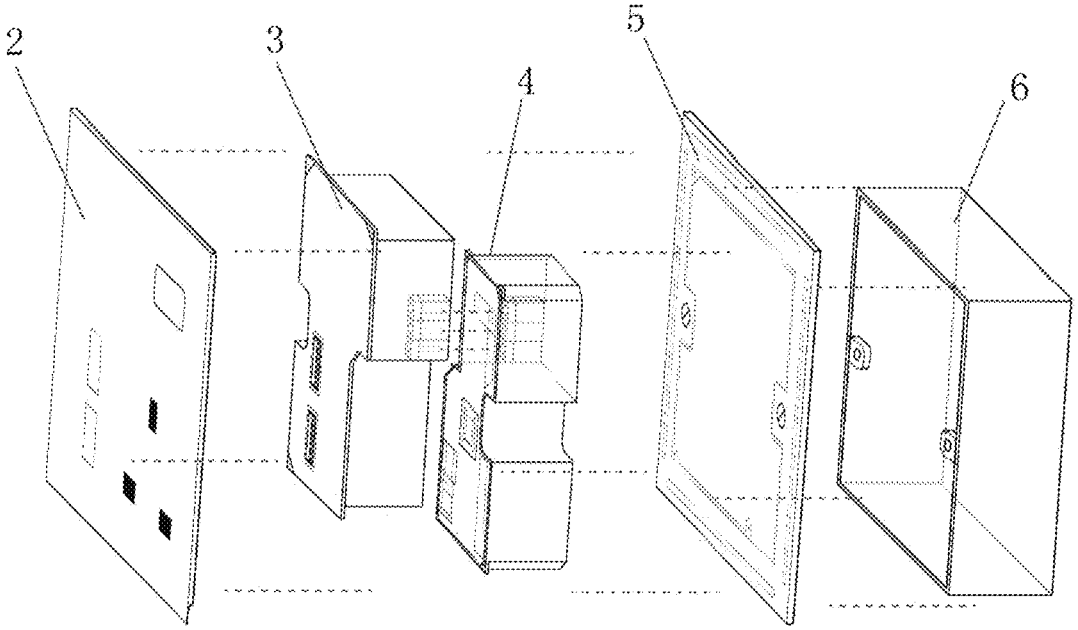
FIG. 14 is a schematic view showing the connection of the socket according to the first embodiment of the invention.
Figure 15:
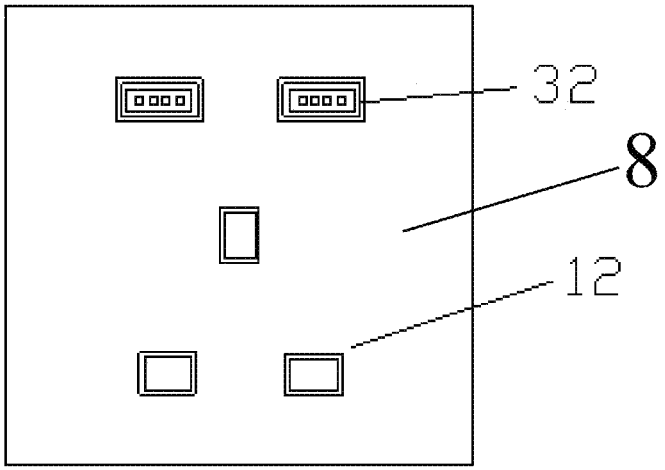
FIG. 15 is a front view of a single unit wall power socket according to a second embodiment of the invention.
Figure 16:
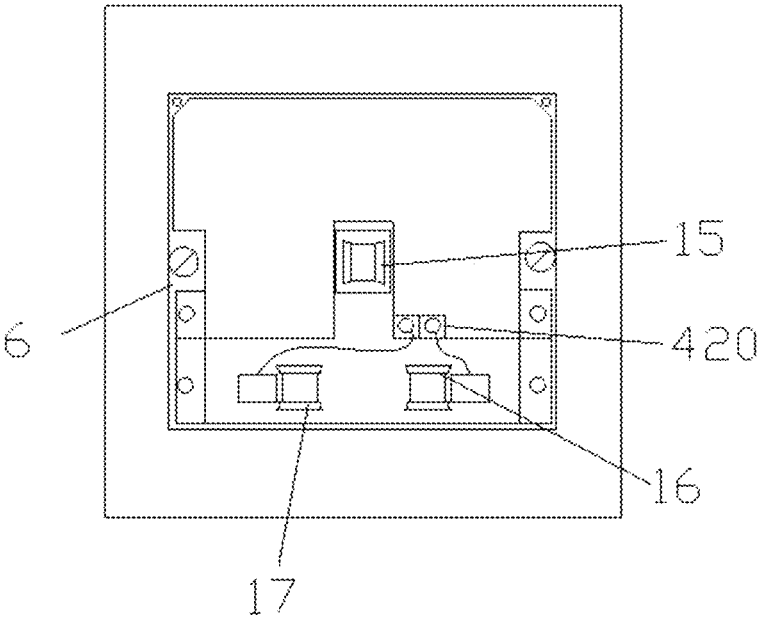
FIG. 16 is a front view of a part of an interior of a socket according to the second embodiment of the invention.
Figure 17:
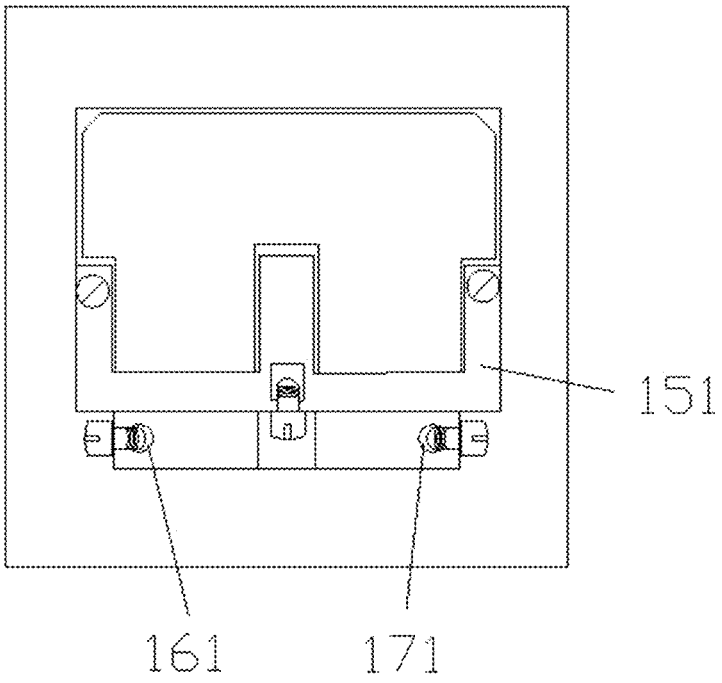
FIG. 17 is a rear view of the socket according to the second embodiment of the invention.
Figure 18:
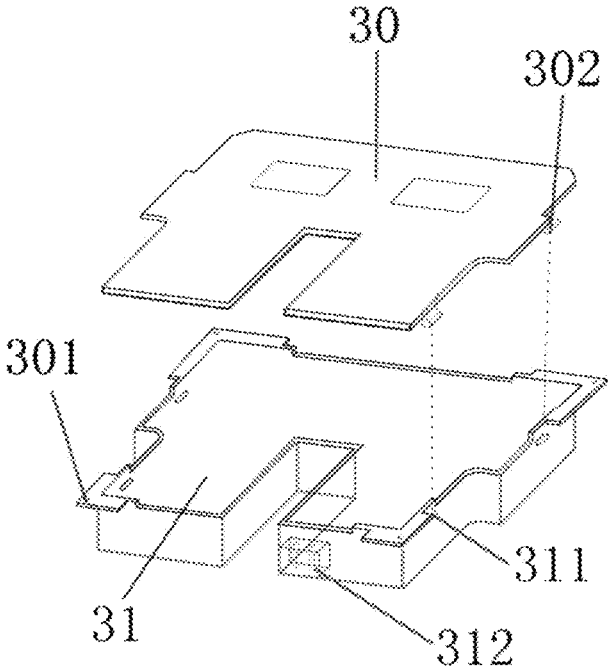
FIG. 18 is a schematic view showing the connection of a function module according to the second embodiment of the invention.
Figure 19:
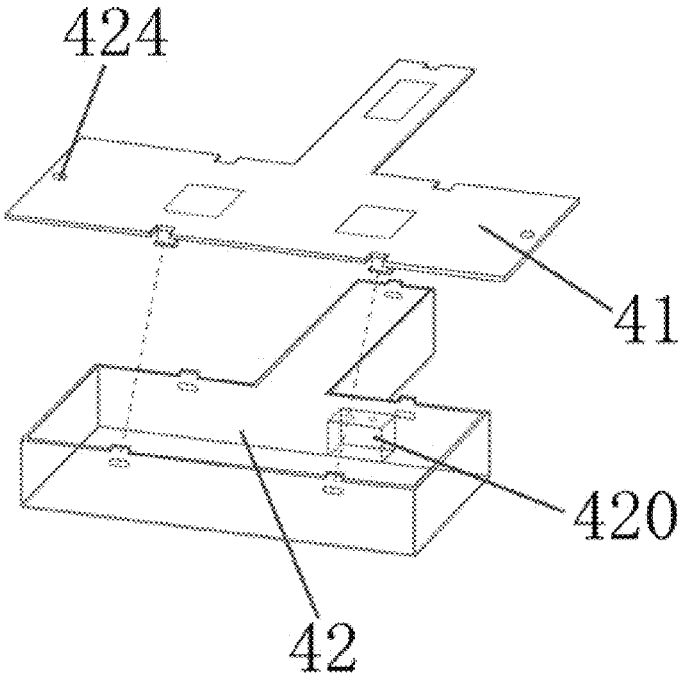
FIG. 19 is a schematic view showing the connection of a power module according to the second embodiment of the invention.

In this embodiment, the socket panel 2 of the socket body 8 is provided with a power switch 14 and a three-pin power socket 12. The socket panel 2 and the socket body 8 are detachably fixed, and the socket panel 2 and the function module 3 are replaced and upgraded accordingly. When the socket body 8 does not accommodate the function module 3, the socket panel 2 provided with no corresponding function area is selected to keep a beautiful look. In an embodiment, when the function module 3 is composed of the function module top cover 30 and the function module bottom box 31, it can plug and play by cooperating with the socket body 8. The function module 3 can be fixed to the screw holes 301 by the hook structure or the fixing frame 6 to detachably fix with the socket body 8, i.e., the function module top cover 31 is fixed on the upper surface of the fixing frame 6 at the screwing holes 301 to facilitate a disassembly and replacement of the function module 3. The socket panel 2 can be set to be open, so that the function module 3 is exposed from the socket body 8 to be a part of the surface of the socket body 8. In an embodiment, as shown in FIG. 14, the panel where the function area of the surface of the socket body 8 is located, i.e., the socket panel 2, is replaced and upgraded corresponding to the function module 3. Preferably, the socket panel 2 and the socket body 8 are detachably fixed for easy replacements, and the hooks or the holes are provided at the periphery or the bottom of the socket panel to be detachably fixed to the fixing frame 6.

In this embodiment, the fixing frame 6 is an auxiliary member which is configured to provide a fixing auxiliary structure, and the shapes thereof can be changed corresponding to shapes of the socket bottom box 5, so that the socket panel 2, the function module 3, the power module 4 and the socket bottom box 5 are detachably fixed.

The socket body 8 can be enlarged or reduced in accordance with a size of the function module 3, or the function module 3 can be enlarged or reduced in accordance with a size of the socket body 8.

Example 2

As shown in FIGS. 15-19, the Example 2 is provided on basis of Example 1, and the power module and the function module are in an up-down structure. In this embodiment, the expandable and upgradeable universal socket of this embodiment is a fixed socket, and a three-pin power socket 12 and holes corresponding to two USB sockets 32 of the function module are provided at the socket panel.

The function module comprises a function module top cover 30 and a function module bottom box 31. Function components with different functions are accommodated in the function module bottom box 31. The function module top cover 30 and the function module bottom box 31 are detachably fixed by the hooks 302 and the holes 311, which facilitates repair, upgrade and reuse of the function module 3. The function module bottom box 31 comprises a bypass pin 312.

The power module of the socket body 8 comprises a power module top cover 41 and a power module bottom box 42. The earth contact 15, the live contact 16 and the neutral contact 17 are accommodated in the power module bottom box 42. The bypass pin socket 420 is connected to a live contact 16 and the neutral contact 17 via wires. The earth contact 15 is connected to the ground metal sheet 151. The live connection port 161 is connected to the live wire of the AC power supply. The neutral connection port 171 is connected to the neutral wire of the AC power supply. The ground connection port is connected to the ground wire of the AC power supply. The power module top cover 41 and the power module bottom box 42 can be detachably connected by hooks and holes.

The bypass pin socket 420 comprises a bypass live outlet and a bypass neutral outlet. The bypass pin 312 comprises corresponding pins. The bypass pin 312 cooperates with the bypass pin socket 420 to detachably connect the power supply circuit of the function module to the power supply circuit of the socket body 8.

The function module is detachably fixed to the fixing frame 6 at the screw hole 301, and the power module is fixed to the fixing frame 6 at the screw hole 424. When the function module is required to be replaced and upgraded, the socket panel 2 is firstly removed, and the fixing frame is replaced to plug and play without removing the fixing frame 6. The socket panel is preferably fixed by means of a detachable connection.

The socket body 8 of the present invention may also be a mobile socket, such as a multi-port socket strip, which can also be arranged based on the above implementation.

Example 3

Figure 20:
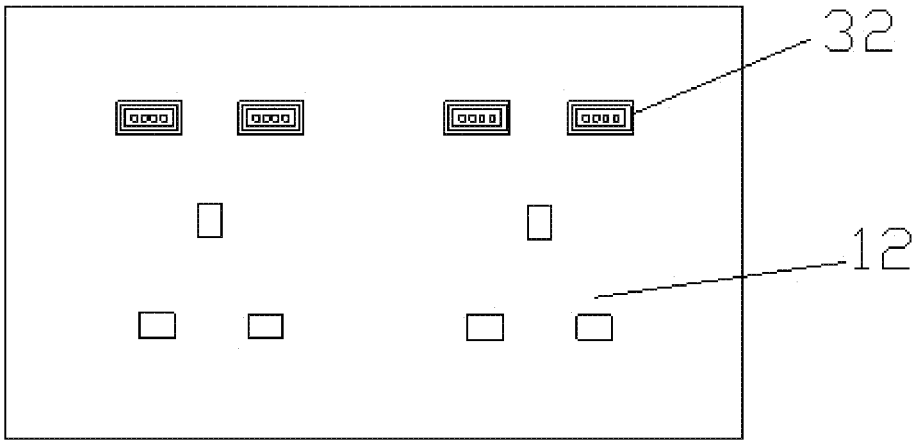
FIG. 20 is a front view of a double-unit wall power socket according to a third embodiment of the invention.
Figure 21:
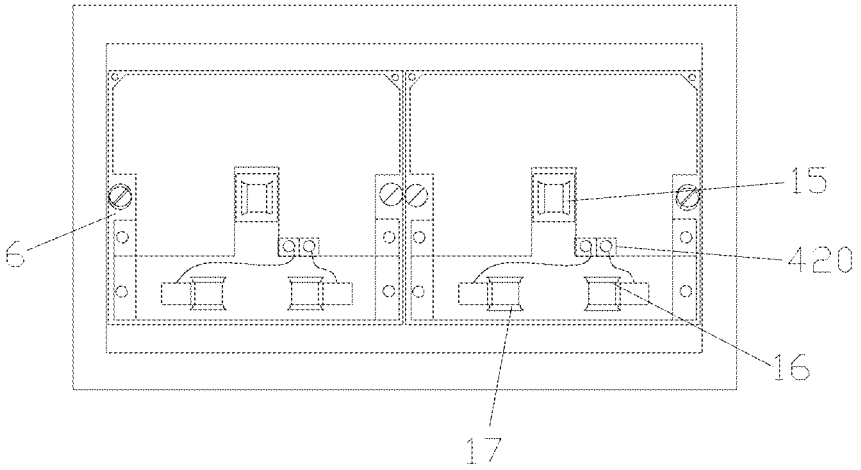
FIG. 21 is a front view showing a part of an interior of the double-unit wall power socket according to a third embodiment of the invention.

As shown in FIGS. 20 and 21, in this embodiment, a double-unit socket is provided on the basis of Example 2, and the power module and the function module composed of a plurality of function module units may be arranged in a separate fashion, or an integrated or grouped fashion. The function module and the power module may be accommodated in one fixing frame or a plurality of fixing frames 6. The earth contact 15, the live contact 16 and the neutral contact 17 are accommodated in the power module. The bypass pin socket 420 is connected to the live contact 16 and the neutral contact 17 via wires.

Example 4

Figure 22:
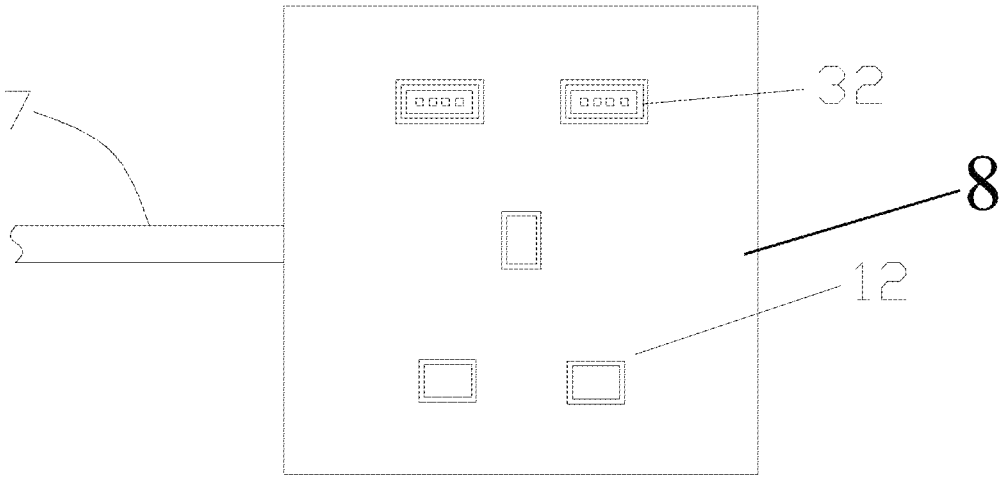
FIG. 22 is a front view of a single unit extension board according to a fourth embodiment of the invention.
Figure 23:
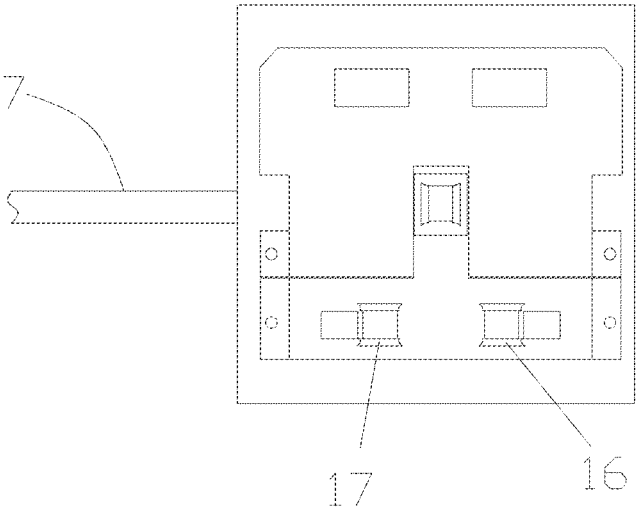
FIG. 23 is a front view showing a partial internal structure of the single unit extension board according to the fourth embodiment of the invention.

As shown in FIGS. 22 and 23, in this embodiment, a single unit extension board is provided on basis of Example 2. The socket body 8 is connected to the mains interface via an extension cord 7. A three-pin power socket 12 and holes corresponding to two USB sockets 32 of the function module are provided on the socket panel. The earth contact, the live contact 16 and the neutral contact 17 are accommodated in the power module.

Example 5

Figure 24:
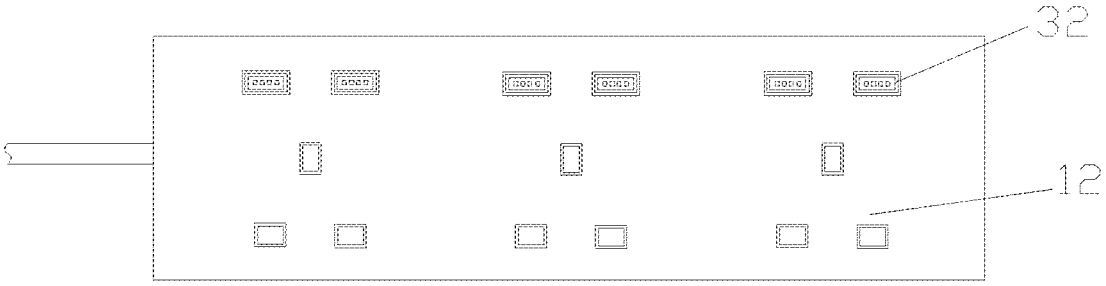
FIG. 24 is a front view of a triple-unit extension board according to a fifth embodiment of the invention.
Figure 25:
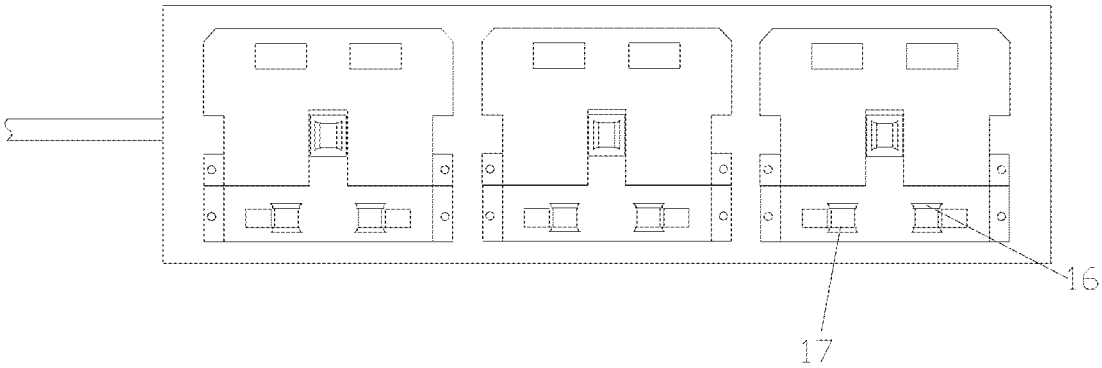
FIG. 25 is a front view showing an interior of the triple-unit extension board according to the fifth embodiment of the invention.

As shown in FIGS. 24 and 25, a triple-unit extension board are provided on basis of Example 4. The socket panel thereof is replaceable, and is provided a plurality of holes corresponding to the USB socket 32 and three-pin power socket 12. The power module and the function module composed of a plurality of module units may be in a separate, integrated or grouped fashion.

It should be understood that modifications and changes may be made by those skilled in the prior art on the basis of above description, which shall fall within the scope of the appended claims.

The invention is exemplarily described in conjunction with the accompanying drawings. Obviously, the implementations of the present invention are not limited by the above embodiments. Improvements and applications in accordance with idea and principle of the invention shall fall within the scope of the present invention.

What is claimed is:

1. An expandable and upgradeable universal socket, comprising a socket body, a function module and a power module;

wherein the function module is replaceable and upgradeable, and is detachably fixed to the socket body; a power circuit of the function module is separably connected to a power circuit of the socket body to enable the function module to plug and play; a space is provided in the socket body to accommodate the function module, and a surface of the socket body is provided with a function area corresponding to the function module;

the power module comprises a first L-shaped structure and a bypass pin socket; the function module comprises a second L-shaped structure and a bypass pin; the bypass pin socket is arranged at a bottom end of an outer side of a protruding part of the first L-shaped structure; the bypass pin is arranged at a bottom end of an inner side of a protruding part of the second L-shaped structure; the bypass pin is inserted into the bypass pin socket, such that the first L-shaped structure fits the second L-shaped structure to form a substantially rectangular structure.

2. The expandable and upgradeable universal socket of claim 1, wherein the function module is configured for at least one of a USB interface, a network interface, a Bluetooth management, a wireless management, a power switch, a speaker and a night light.

3. The expandable and upgradeable universal socket of claim 1, wherein a panel for the function area on the surface of the socket body is detachably fixed to the socket body, and the panel is replaced and upgraded correspondingly with the function module.

4. The expandable and upgradeable universal socket of claim 1, wherein the function module is directly and detachably fixed to the socket body; or the function module is detachably fixed to an auxiliary member which is then fixed to the socket body.

5. The expandable and upgradeable universal socket of claim 3, wherein a plurality of hooks or holes are arranged at a periphery or a bottom of the panel for a detachable and fixed connection between the panel and the socket body; or the panel is detachably fixed to the auxiliary member which is then fixed to the socket body.

6. The expandable and upgradeable universal socket of claim 4, wherein the auxiliary member is a fixing frame.

7. The expandable and upgradeable universal socket of claim 5, wherein the auxiliary member is a fixing frame.

8. The expandable and upgradeable universal socket of claim 1, wherein the power circuit comprises a live circuit, a neutral circuit, and a ground circuit.

9. The expandable and upgradeable universal socket of claim 1, wherein the socket body is a mobile socket or a fixed socket.

10. The expandable and upgradeable universal socket of claim 1, wherein the function module further comprises a function module top cover, a function module bottom box and a USB socket.

11. The expandable and upgradeable universal socket of claim 1, wherein the power module further comprises a power module bottom box; an earth contact, a live contact, and a neutral contact are accommodated in the power module bottom box.

12. The expandable and upgradeable universal socket of claim 1, wherein the bypass pin socket further comprises a bypass live outlet, a bypass ground outlet, and a bypass neutral outlet.

* * * * *